US012708225B2

(12) United States Patent
Peer

(10) Patent No.: US 12,708,225 B2
(45) Date of Patent: Aug. 18, 2026

(54) DUAL APPLICATION SCREW-IN HOOK AND HANGING SYSTEM

(71) Applicant: Roy Peer, Brandon, FL (US)

(72) Inventor: Roy Peer, Brandon, FL (US)

( * ) Notice: Subject to any disclaimer, the term of this patent is extended or adjusted under 35 U.S.C. 154(b) by 0 days.

(21) Appl. No.: 19/320,845

(22) Filed: Sep. 5, 2025

(65) Prior Publication Data

US 2026/0096675 A1 Apr. 9, 2026

Related U.S. Application Data

(60) Provisional application No. 63/703,944, filed on Oct. 5, 2024.

(51) Int. Cl.
*A47F 5/08* (2006.01)

(52) U.S. Cl.
CPC ..... *A47F 5/0823* (2013.01)

(58) Field of Classification Search
CPC ..... A47F 5/0823
See application file for complete search history.

(56) References Cited

U.S. PATENT DOCUMENTS 3,128,979 A * 4/1964 Damelio ..... B41J 29/04 248/680
3,310,271 A * 3/1967 King ..... A47F 5/0815 248/222.52
3,850,396 A * 11/1974 Orlandi ..... A47F 5/0815 248/220.42
4,434,960 A * 3/1984 Berry ..... A47F 5/0815 248/223.31
4,893,777 A * 1/1990 Gassaway ..... E05B 73/0082 211/8
5,379,976 A * 1/1995 DeGirolamo ..... B25H 3/04 248/222.51
5,529,192 A * 6/1996 Conen ..... A47B 96/028 211/187
5,762,211 A * 6/1998 Ensign ..... A47F 5/0861 211/70.6
5,881,982 A * 3/1999 Hollingsworth .... F16B 19/1081 248/222.12
6,423,898 B1 * 7/2002 Croker ..... G02B 6/44526 248/68.1
D478,235 S * 8/2003 Gruskin ..... D6/574
7,677,400 B2 * 3/2010 Bayazit ..... H04Q 1/062 211/26
D678,701 S * 3/2013 Hansen ..... D6/561
8,459,472 B2 * 6/2013 Hofman ..... A47F 5/0815 211/106.01
9,581,782 B2 * 2/2017 Abby ..... B65H 75/446
D1,025,652 S * 5/2024 Shen ..... D6/553
(Continued)

*Primary Examiner* — Terrell L McKinnon
*Assistant Examiner* — Ding Y Tan
(74) *Attorney, Agent, or Firm* — Patent 360; Barry Choobin

(57) ABSTRACT

A versatile dual-application hook and storage system is disclosed. A mounting shaft with a central pass-through bore enables tool-free engagement with pegboards or slotted panels via a keyhole opening and also permits direct or through-panel wall mounting with a fastener. Lateral pin-lock features provide rotational stability. The system supports interchangeable accessories including but not limited to hooks, straps, baskets, and other storage or non-storage elements across multiple surface types in a compact, space-efficient design.

15 Claims, 7 Drawing Sheets

(56) References Cited

U.S. PATENT DOCUMENTS

| | | | | |
|---|---|---|---|---|
| D1,048,720 | S * | 10/2024 | Gee | D3/319 |
| 2001/0013567 | A1* | 8/2001 | Valiulis | A47F 5/0861 248/220.31 |
| 2005/0242047 | A1* | 11/2005 | Winig | A47F 5/0815 211/59.1 |
| 2014/0374549 | A1* | 12/2014 | Bernstein | A47F 5/0823 248/125.3 |
| 2021/0093081 | A1* | 4/2021 | Parker | A47F 5/0823 |
| 2022/0000284 | A1* | 1/2022 | Segrest | A47F 5/0823 |
| 2024/0122377 | A1* | 4/2024 | Dickson | A47F 5/0823 |

* cited by examiner

DUAL APPLICATION SCREW-IN HOOK AND HANGING SYSTEM

CROSS REFERENCE TO RELATED APPLICATIONS

This application claims priority from a U.S. Provisional Patent Appl. No. 63/703,944, filed on Oct. 5, 2024, which is incorporated herein by reference in its entirety.

FIELD OF INVENTION

The present invention relates generally to storage systems, and more particularly to a versatile dual-application hook and storage system for accommodating various accessories, including hooks, straps, baskets, and other storage and non-storage items, adapted for use with pegboards, slotted hanging systems, and direct wall installation.

BACKGROUND

Conventional storage systems frequently require different types of hooks or accessories depending on the mounting surface—such as pegboards, slotted wall systems, or flat walls. These traditional systems are generally compatible with only one type of accessory, often necessitating multiple steps or additional hardware for installation. As a result, such systems can be cumbersome to use, inefficient in space utilization, and limited in flexibility. There exists a continuing need for improved storage solutions, particularly those offering greater versatility, simplified installation, and adaptability for a variety of applications

SUMMARY OF THE INVENTION

The following provides a simplified summary of one or more embodiments of the present invention to facilitate a basic understanding of the invention. This summary is not intended to provide an exhaustive overview of all possible embodiments, nor to identify key or essential elements of the invention or to define its full scope. Rather, it serves solely as an introduction to certain concepts that are further described in detail in the subsequent sections.

The principal object of the present invention is therefore directed to a highly adaptable, multi-functional storage solution that simplifies organization while maximizing space efficiency and ease of installation.

Another object of the present invention is to ensure enhanced stability by securely locking the hook or accessory in place, thereby preventing unintended dislodgment during use.

Yet another object of the present invention is to enable compatibility with a variety of mounting surfaces, including pegboards, slotted wall systems, and flat wall surfaces.

A further object of the present invention is to provide a compact and efficient installation that minimizes the need for additional mounting components or tools.

In one aspect, disclosed is a dual-application hook and storage system that can be adapted easily to multiple mounting surfaces. The system includes a dual-function attachment mechanism featuring a keyholes for pegboards and slotted systems, and a screw-through design for secure direct wall installation. This configuration simplifies installation, enhances space efficiency, and supports a broad range of accessories including hooks, straps, baskets, and others.

BRIEF DESCRIPTION OF DRAWINGS

The accompanying figures, which are incorporated herein and form a part of the specification, illustrate various embodiments of the present invention. Together with the detailed description, the figures serve to explain the principles of the invention and enable a person skilled in the relevant art to make and use the invention.

DETAILED DESCRIPTION

Figure 1:
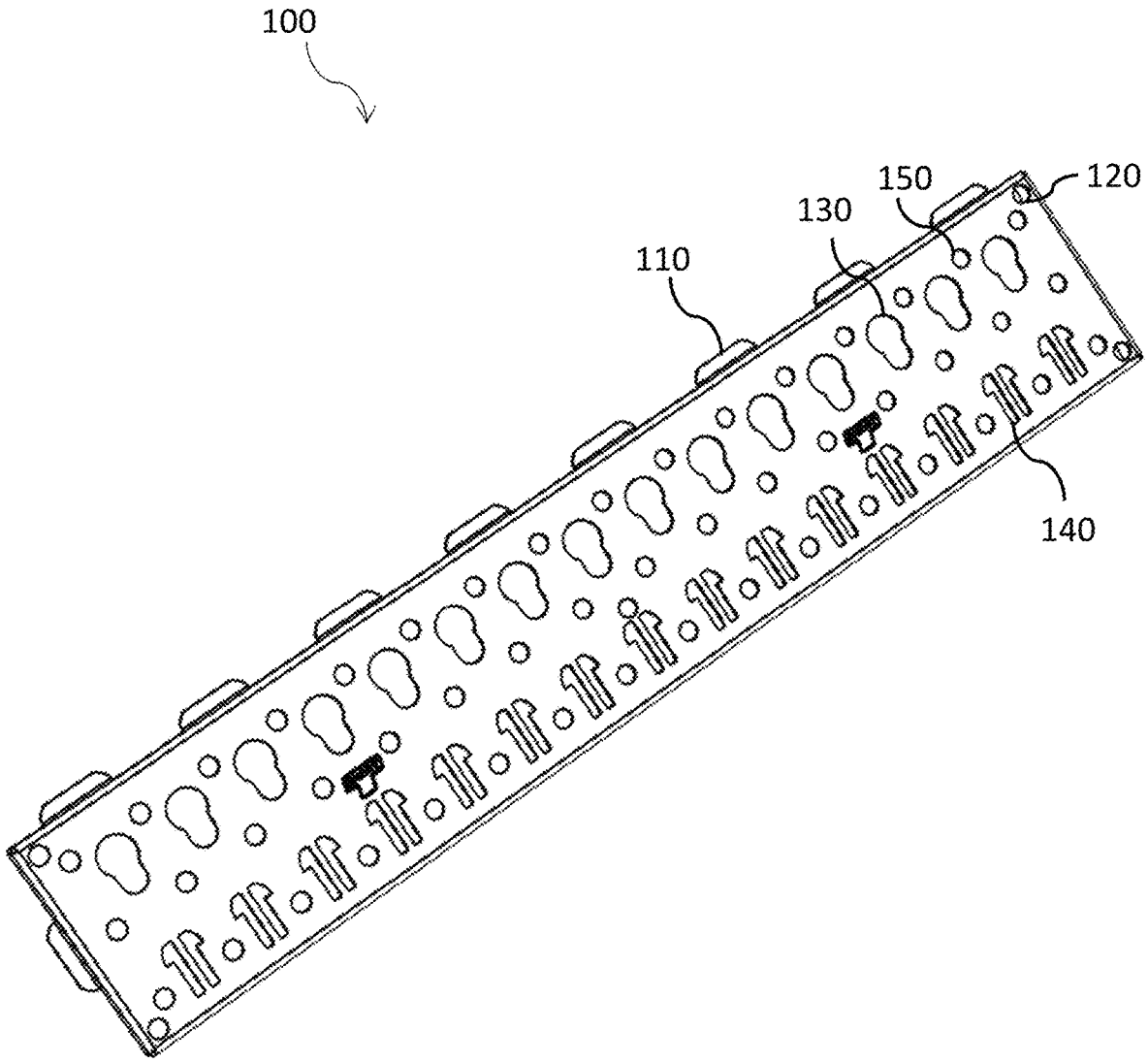
FIG. 1 shows a perspective view of a board member of the storage system, according to an exemplary embodiment of the present invention.

The subject matter of the present invention will now be described in greater detail with reference to the accompanying drawings, which form a part of this specification and illustrate specific exemplary embodiments. It should be understood, however, that the invention may be embodied in various forms, and the scope of the claimed subject matter is not limited to the particular embodiments set forth herein. The exemplary embodiments are provided solely for illustrative purposes. The invention may be implemented as methods, devices, systems, or components thereof. Accordingly, the following detailed description is not intended to be limiting in scope.

As used herein, the term "exemplary" means "serving as an example, instance, or illustration." Any embodiment described as "exemplary" is not necessarily preferred or more advantageous than other embodiments. Additionally, the phrase "embodiments of the present invention" does not require that all embodiments include the same features, advantages, or modes of operation.

The terminology used herein is for the purpose of describing particular embodiments only and is not intended to be limiting. As used herein, the singular forms "a," "an," and "the" include the plural forms unless the context clearly dictates otherwise. Furthermore, the terms "comprises," "comprising," "includes," and "including" are intended to specify the presence of stated features, elements, steps, or components, but do not preclude the presence or addition of one or more other features, elements, steps, or components.

The following detailed description sets forth the best currently contemplated modes for carrying out the invention. This description is provided solely to illustrate the general principles of the invention and is not intended to limit its scope, which will be defined by the claims of any issued patent The present invention relates to a storage system and a method of using the storage system for organizing and storing various items. The storage system includes a board member equipped with a dual-function attachment mechanism, and one or more attachment members. The attachment members may include hooks, straps, baskets, and other types of storage accessories. In particular, the attachment members may comprise hook-type elements as well as accessories incorporating integral hook features. Such accessories may include, for example, baskets and similar storage components.

The board member includes one or more rows of keyhole-shaped openings, with the keyholes evenly spaced along each row. These keyholes are configured to be compatible with standard pegboards or slotted hanging systems, allowing for secure and tool-free installation of attachment members. Positioned below the keyholes are pin-lock holes, which may include a pair of axially symmetric "axe-shaped" openings—specifically, a left and a right axe-shaped hole that are mirror images of each other. These pin-lock holes form part of a pin-lock mechanism that enhances stability by securely locking the attachment member in place and preventing unintentional dislodgement. The axe-shaped opening forms laterally flared locking lobes.

Adjacent to the keyholes and pin-lock holes are multiple screw holes, which accommodate fasteners such as threaded screws. These screw holes enable the direct mounting of various accessories and also allow the board member itself to be securely affixed to a supporting surface, such as a wall, using appropriate fasteners.

The provision of keyholes, pin-lock holes, and screw holes enables a versatile, flexible, and space-efficient mounting solution. Various types of attachment members, such as different styles of hooks, can be mounted to the board member using corresponding attachment mechanisms. The storage system is further capable of accommodating a wide range of both storage and non-storage accessories beyond hooks, including straps, baskets, and other attachments that require hanging or secure fastening.

Figure 2:
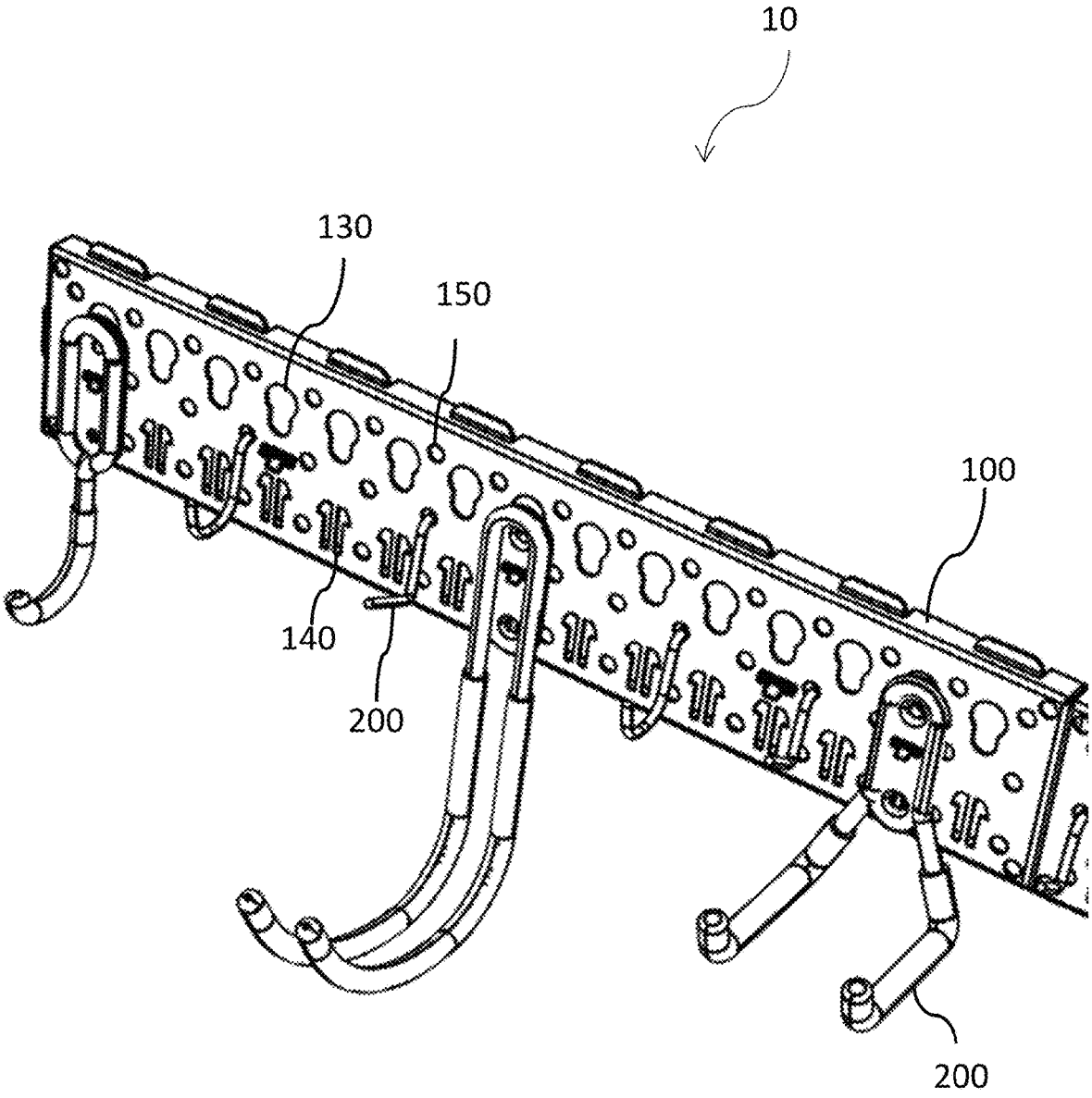
FIG. 2 shows the board member with attachment members, according to an exemplary embodiment of the present invention.
Figure 3:
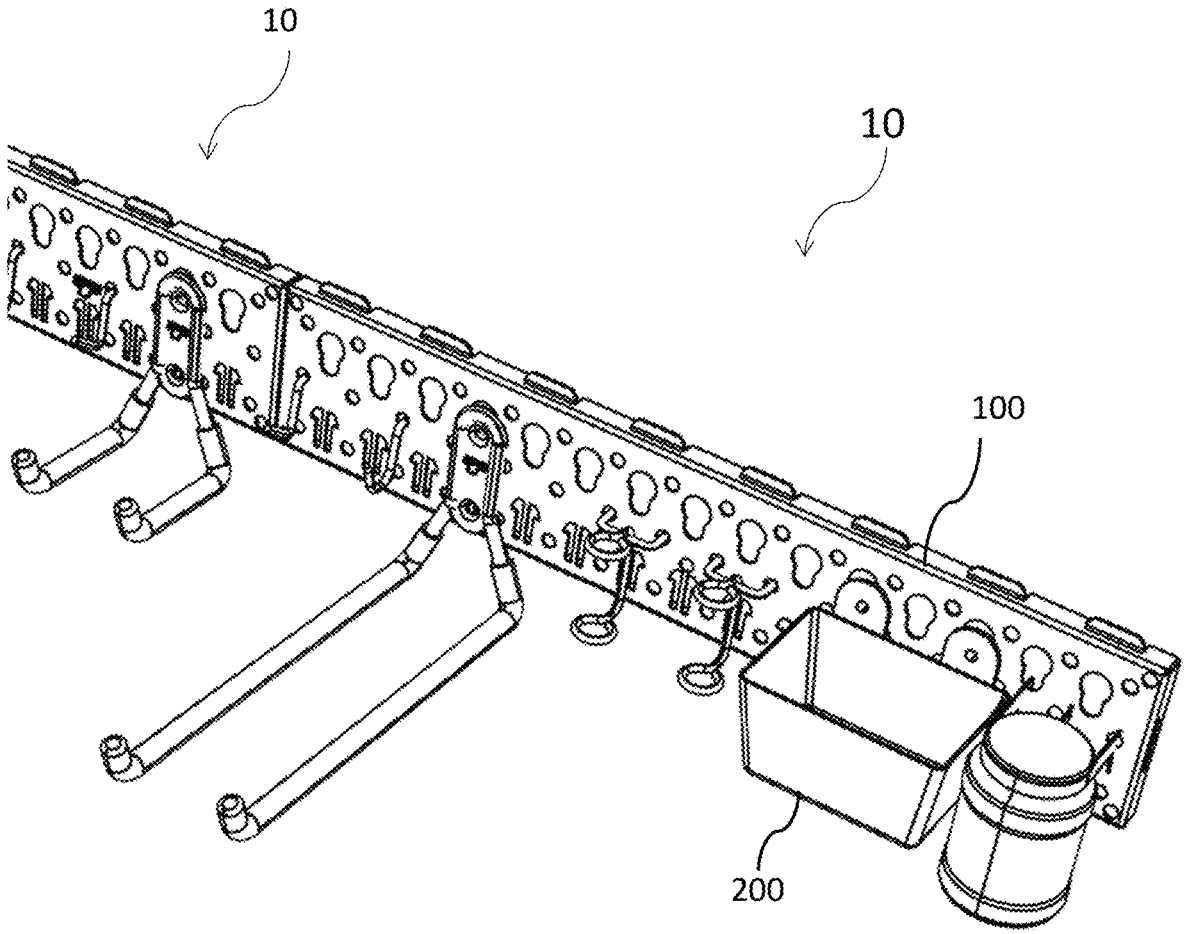
FIG. 3 shows two board members positioned side-by-side, according to an exemplary embodiment of the present invention.

Referring to FIGS. 1-4, a storage system 10 is illustrated, comprising one or more board members 100 and various attachment members 200. As shown in FIG. 1, each board member 100 has a planar, elongated profile resembling a plate. Located along the opposite long sides of the board member are snap clips 110, which enable side-by-side coupling of multiple board members. For instance, FIG. 3 shows two board members coupled together laterally to form an extended, continuous board structure. In this configuration, one board member includes snap clips 110, while the adjacent board member includes elongated slots designed to receive the clips for secure interlocking.

The board member 100 depicted in FIG. 1 includes snap clips on two adjacent sides and corresponding clip-receiving slots on the remaining two sides, allowing for modular connectivity in multiple directions. Additionally, each of the four corners of the board member includes a mounting hole 120. These holes are configured to receive screws or other fasteners for securing the board member to a supporting surface, such as a wall.

The board member 100 includes a row of keyholes 130, each having an elongated profile with rounded edges, a broader upper portion, and a narrower lower portion. These keyholes are designed to accommodate various hook-type attachment mechanisms. Positioned directly below each keyhole 130 is a corresponding pin-lock hole 140, forming a vertically aligned pair for secure dual-point engagement.

On the left and right sides of each keyhole 130 and pin-lock hole 140 are multiple screw holes 150—specifically, six screw holes arranged to provide additional mounting options. These screw holes are suitable for use with rivet-type fastening mechanisms or threaded fasteners, allowing for secure attachment of accessories or reinforcement of mounted components.

Figure 4:
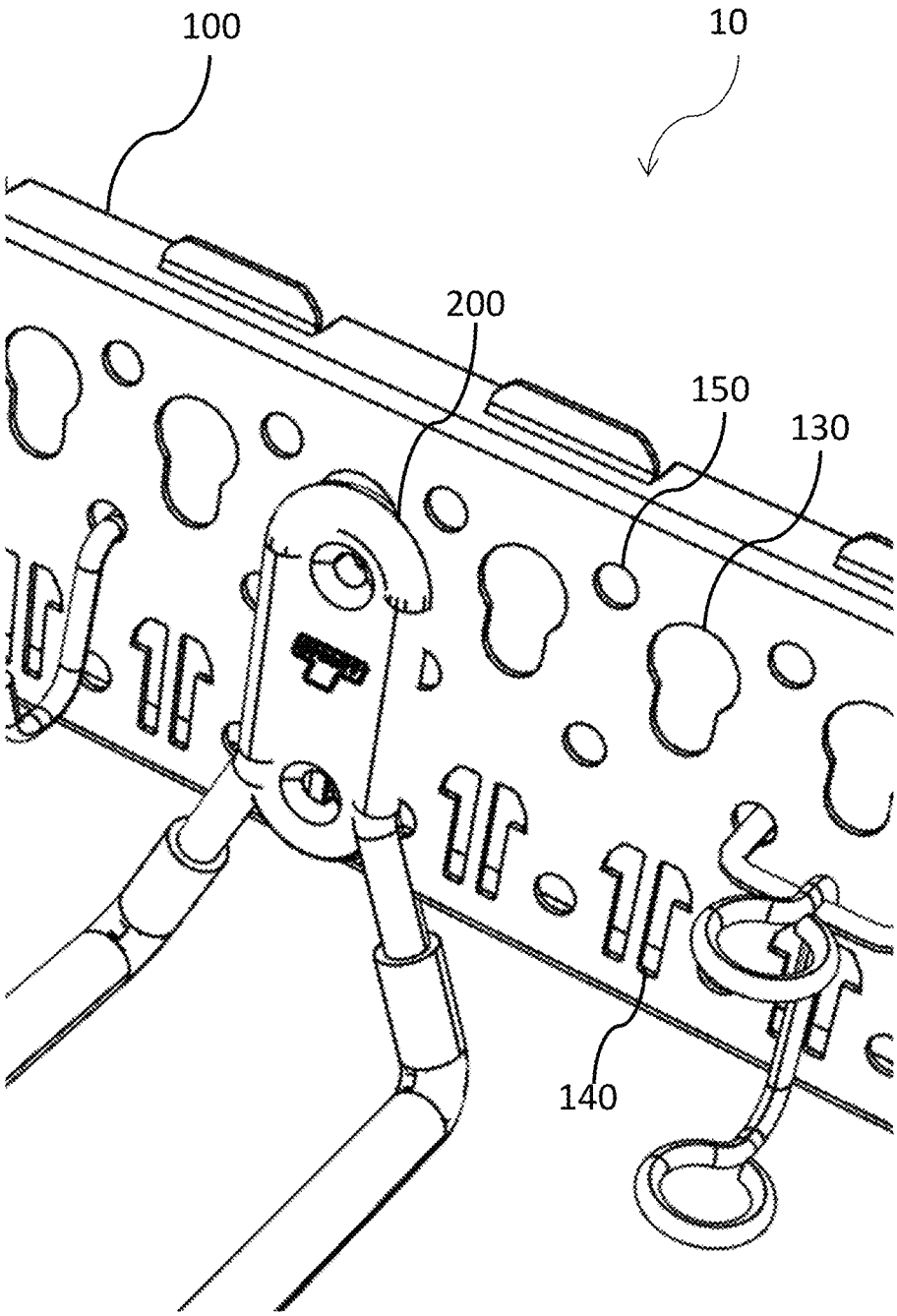
FIG. 4 shows an enlarged view of the board member, according to an exemplary embodiment of the present invention.

Two or more board members may be positioned side-by-side to create a larger, continuous board surface. As shown in FIG. 2, two board members are aligned along their longitudinal axes and coupled together. FIGS. 2-4 further illustrate various attachment members mounted to the board member. FIG. 4 provides an enlarged view of the board member 100, highlighting the arrangement of keyholes, pin-lock holes, and other features.

Figure 5:
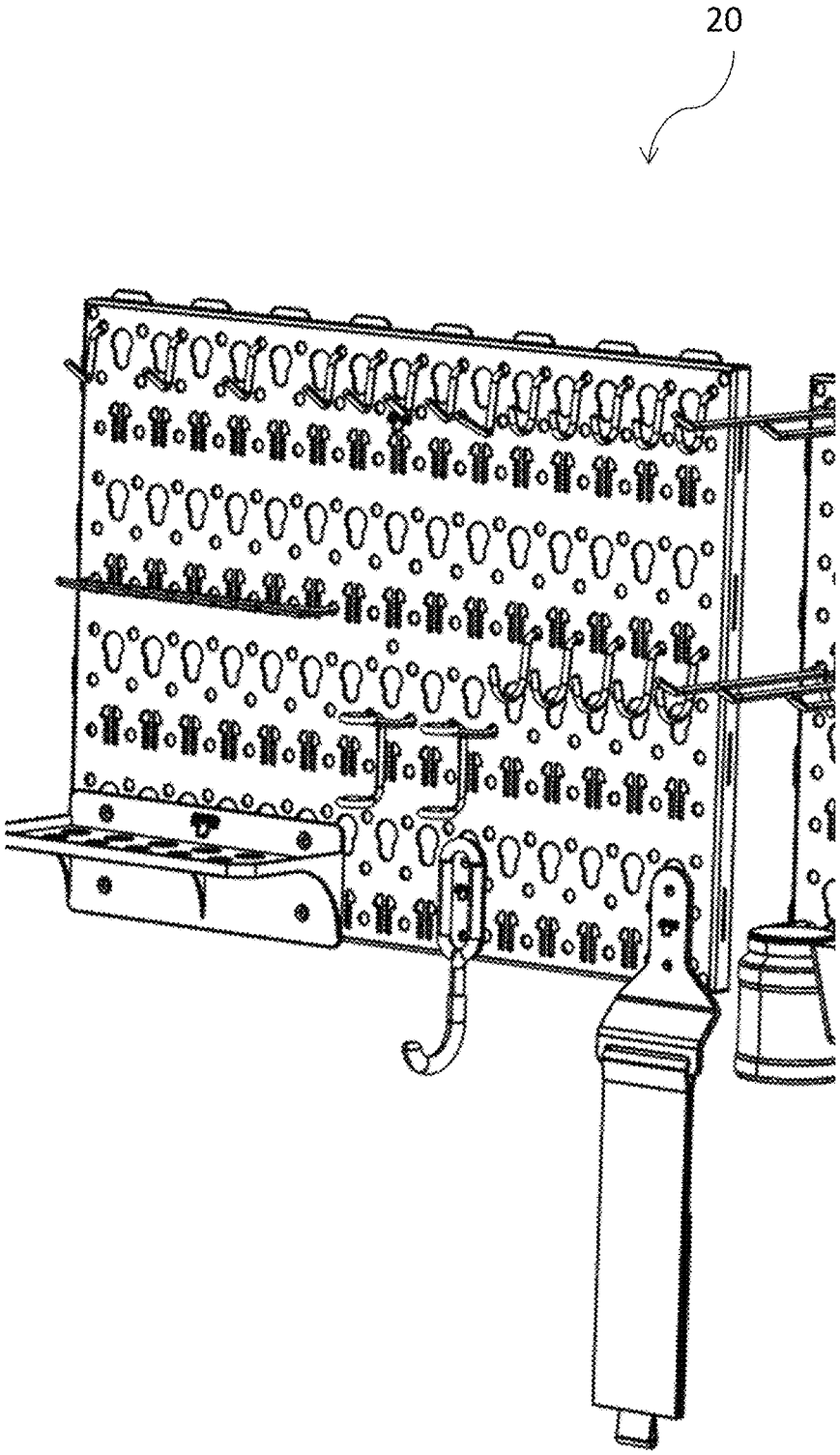
FIG. 5 shows another implementation of the board member, according to an exemplary embodiment of the present invention.

FIG. 5 illustrates an alternative implementation of the storage system, designated as storage system 20. In this embodiment, the board member includes multiple rows of keyholes and pin-lock holes, with the rows arranged in a parallel configuration. This layout allows for greater flexibility in the placement and type of accessories that can be mounted. A wide variety of accessories, including hooks, baskets, and straps, may be securely attached to the board member of storage system 20.

Figure 6:
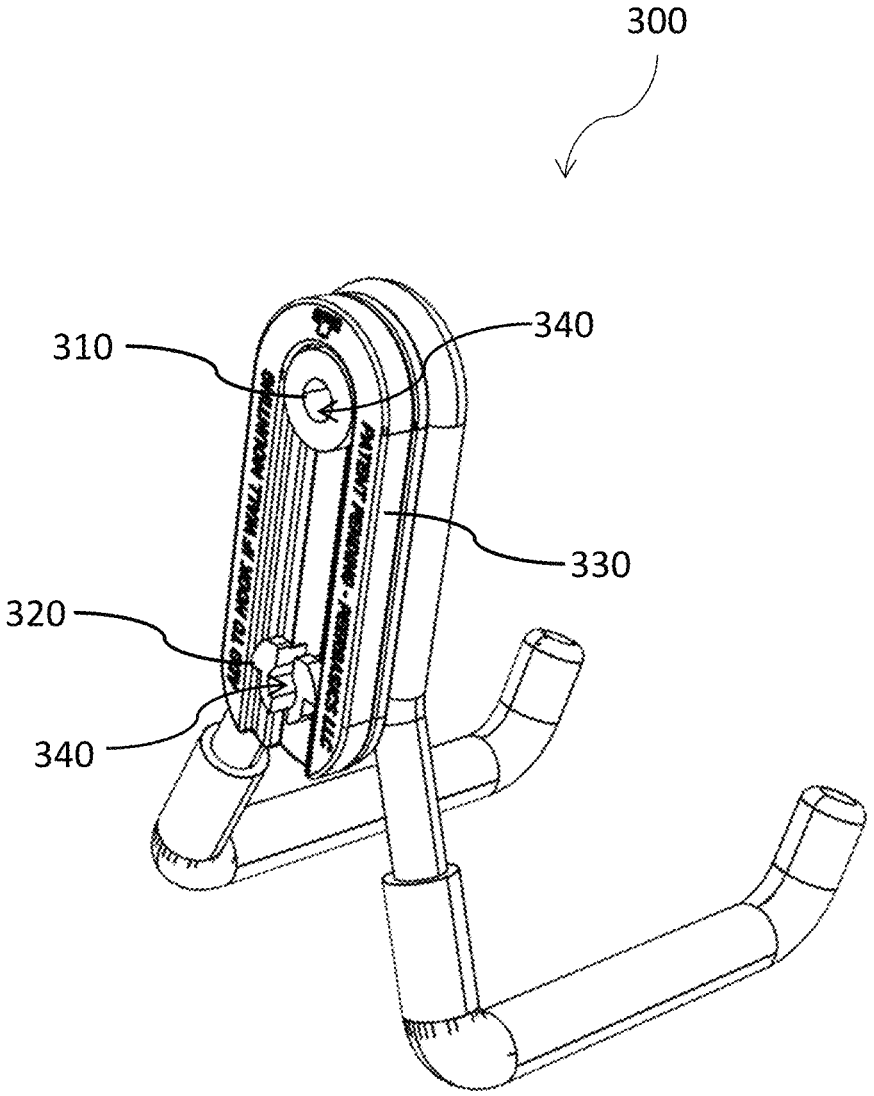
FIG. 6 shows an attachment member, according to an exemplary embodiment of the present invention.

FIG. 6 illustrates an embodiment of an attachment member in the form of a hook 300, which is configured for secure engagement with a keyhole 130 and a corresponding pin-lock hole 140 on the board member. The hook 300 includes a cylindrical plug 310 and a lock-in plug 320. The cylindrical plug 310 is designed to be inserted into the keyhole 130, while the lock-in plug 320 is inserted into the pin-lock hole 140. The lock-in plug 320 forms part of the pin-lock mechanism and includes two tabs or prongs configured to engage with the left and right axe-shaped holes of the pin-lock hole 140. These tabs provide lateral anchoring and resist rotational or unintended dislodgment of the hook, which is especially important when the board is mounted vertically on a wall.

A spacer plate 330 is positioned around both the cylindrical plug 310 and the lock-in plug 320. The width of the spacer plate 330 may correspond to the combined heights of the plugs, thereby forming a low-profile assembly. The spacer plate 330 serves to protect the plugs during storage and transportation. The spacer plate 330 also provides additional surface stability when the hook is mounted directly to a wall or similar supporting structure.

The spacer plate 330 is optionally removable to accommodate different mounting configurations. For example, the spacer plate 330 may be removed when the hook 300 is mounted to a snap-compatible board, and retained when mounting the hook to a flat supporting surface, such as a wall. The hook 300 can also be mounted directly to a supporting structure using fasteners such as screws, rivets, or bolts. Both the cylindrical plug 310 and the lock-in plug 320 include pass-through holes 340, allowing a fastener to be inserted through the plug and into the underlying surface.

This configuration enables the hook 300 and similar attachment members to be mounted using a dual-attachment mechanism—via the keyhole/pin-lock system or directly with fasteners, greatly enhancing the versatility of the system. A fastener may also be used in combination with the board member 100 to further secure the hook to the board itself. Additionally, a fastener inserted through the pass-through hole and into a supporting structure, such as a wall, creates a compression effect. This compression locks the plug flush against the surface, providing both vertical load-bearing capacity and lateral stability.

This integrated design eliminates the need for a separate wall-mountable version of the hook, making the hook 300 universally applicable across various mounting platforms. As a result, the design reduces the number of required product variants (SKUs), simplifies inventory management, and enhances user convenience.

The board member may be constructed from durable materials such as metal or heavy-duty plastic, selected for strength, corrosion resistance, and longevity, making it suitable for residential, commercial, and industrial use.

The key innovation in this system is a dual-mode mounting shaft that operates both (i) as a tool-free, panel-engaging rivet sized for insertion into a keyhole of a pegboard or slotted panel and (ii) as a screw-receiving anchor for direct or through-panel wall mounting. A central pass-through bore extends along the shaft. When used with a wall fastener, tightening the fastener draws the shaft toward the wall and cooperatively engages one or more lateral locking features (pin-lock lobes, tabs, prongs, or equivalent) to resist rotation and pull-out, producing a compact, high-stability mount without changing parts.

Additionally, the storage system includes a pin-lock mechanism, which provides further stability by locking the system into place. The pin-lock mechanism is designed to accept a screw that can pass through it for direct wall installation. This screw-through feature allows the hook or accessory to be mounted securely to the wall, while the pin-lock mechanism simultaneously ensures stability in a more compact design, reducing the need for additional mounting components.

The disclosed storage system is designed to accommodate various storage and organizational needs. This system supports not only hooks but also accessories such as straps, baskets, and other storage solutions, offering flexibility across multiple applications. The system is not limited to these examples, as it can facilitate a wide range of accessories, both within and outside the traditional storage realm, making it adaptable for holding diverse items in residential, commercial, and industrial settings.

The core of the invention is a dual-function mechanism that allows for easy attachment to pegboards, slotted hanging systems, and direct wall surfaces. For pegboards and slotted systems, the keyhole-shaped slots enable the system to lock in place without the need for tools, while for wall mounting, the system features a screw that passes through the pass-through holes. This innovative design provides both secure and permanent mounting options, allowing for a compact and efficient installation that reduces the need for additional components.

The pin-lock mechanism enhances stability by locking the hook or accessory firmly into place, preventing unintended dislodging. The dual mechanism design also streamlines the installation process by combining the secure locking function with a wall-mounting screw, offering a more convenient, space-saving solution compared to traditional storage systems. The system is designed with durability in mind, capable of supporting a wide variety of items with different weight loads, making it suitable for numerous applications beyond basic storage.

Referring to FIGS. 7A, 7B, 8A, and 8B, the dual-function attachment mechanism is illustrated, demonstrating how a single attachment member can be mounted either to a board or directly to a wall. The dual-function mechanism refers to a unified structural design that enables both removable hanging—such as on slotted rivet shelving or pegboard systems—and permanent mounting to flat wall surfaces using the same core components. This is achieved through the inclusion of a central pass-through hole in the attachment plugs.

Figure 7A:
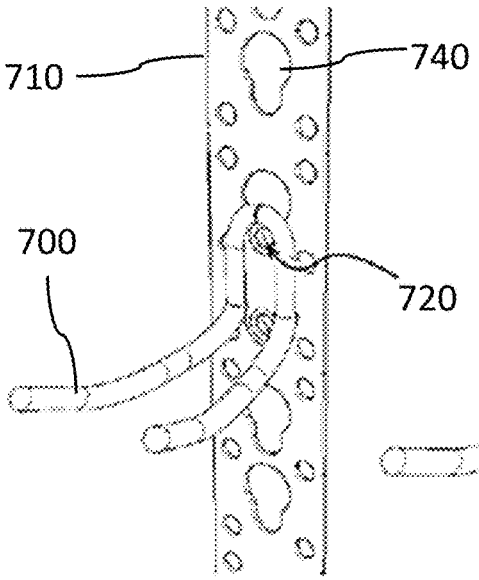
FIG. 7A illustrates an attachment member coupled to a board member through plug interlocking with the keyholes, which can further be secured using a screw through a pass hole in the plug, according to an exemplary embodiment of the present invention.
Figure 7B:
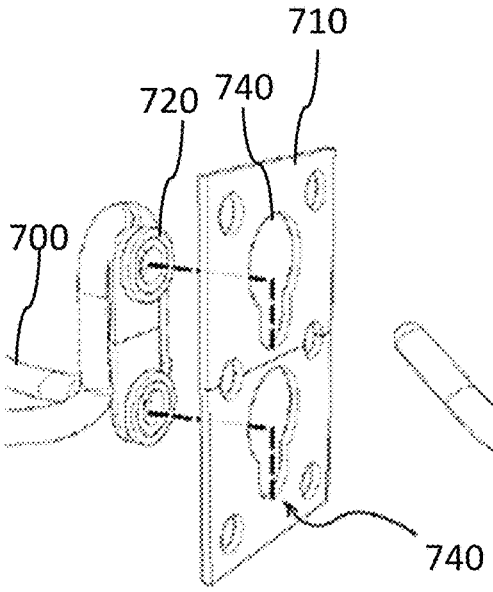
FIG. 7B is an exploded view of FIG. 7A illustrating the coupling mechanism, according to an exemplary embodiment of the present invention.

FIG. 7A depicts a board member 710 featuring a vertically aligned row of keyholes 740. A hook 700, having two cylindrical plugs 720, is mounted to the board member 710 such that each plug engages a corresponding keyhole 740. FIG. 7B provides a clearer view of the two cylindrical plugs 720, each of which includes a pass-through hole 750 for receiving a screw.

Figure 8A:
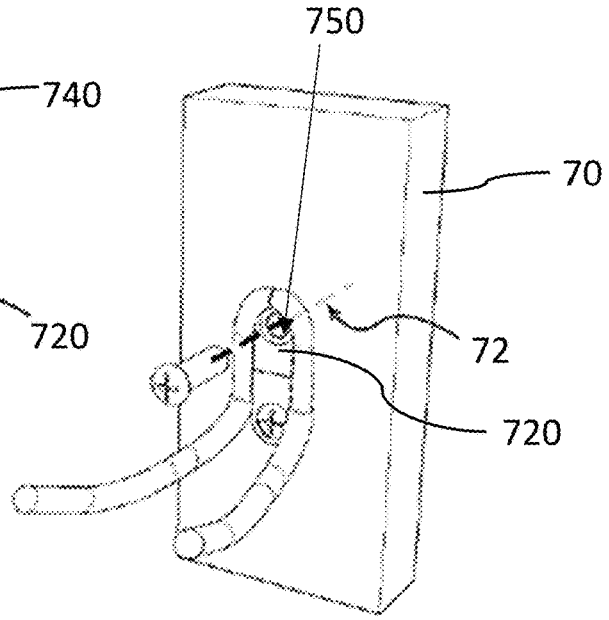
FIG. 8A illustrates the attachment member of FIG. 7A coupled to a flat wall using screws, according to an exemplary embodiment of the present invention.
Figure 8B:
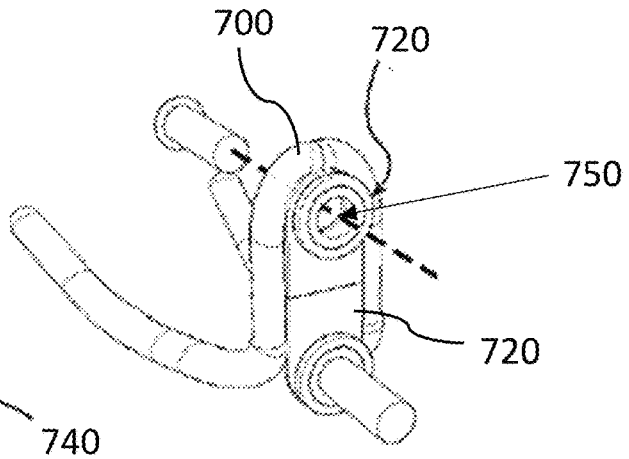
FIG. 8B illustrates the coupling mechanism of FIG. 8A, according to an exemplary embodiment of the present invention.

FIGS. 8A and 8B illustrate the same hook 700 mounted directly to a wall 70. As shown, a fastener such as a screw is inserted through the pass-through holes 750 of the cylindrical plugs 720 and driven into the wall along the axis line 72. This configuration enables secure wall mounting using the same attachment member, without the need for modification or alternate parts.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A storage system comprising:

a board member comprises:

a keyhole of an elongated profile and rounded edges, and having an upper broad rounded portion and a lower narrow rounded portion; and a pin-lock hole positioned below the keyhole, wherein the pin-lock hole comprises a left axe shape hole and a right axe shape hole, wherein the left axe shape hole and the right axe shape hole are mirror images.

2. The storage system of claim 1, further comprising:

a plurality of screw holes positioned adjacent to the key and pin-lock holes.

3. The storage system of claim 1, further comprising:

an attachment member comprising:

a cylindrical plug configured to be inserted into the keyhole; and a lock-in plug configured to engage the pin-lock hole, wherein the lock-in plug has lateral tabs or prongs for rotational stabilization.

4. The storage system of claim 3, wherein the cylindrical plug has a pass-through hole extending along a center of the cylindrical plug, wherein the pass-through hole is configured to receive a fastener.

5. The storage system of claim 4, wherein the attachment member further comprising:

a spacer plate configured to be removably positioned around the cylindrical plug and the lock-in plug, wherein the spacer plate is configured to protect and stabilize the cylindrical plug and the lock-in plug.

6. The storage system of claim 3, wherein the lock-in plug includes two prongs configured to engage the left and right axe-shaped holes of the pin-lock hole to resist rotational displacement.

7. The storage system of claim 3, wherein the cylindrical plug is configured to expand under compression, forming a rivet type fastener.

8. A method for storing items, the method comprising:

providing a storage system comprising:

a board member comprising:

a keyhole of an elongated profile and rounded edges, and having an upper broad rounded portion and a lower narrow rounded portion; and a pin-lock hole positioned below the keyhole, wherein the pin-lock hole comprises a left axe shape hole and a right axe shape hole, wherein the left axe shape hole and the right axe shape hole are mirror images; and an attachment member comprising:

a cylindrical plug configured to be inserted into the keyhole; and a lock-in plug configured to engage the pin-lock hole, wherein the lock-in plug has lateral tabs or prongs for rotational stabilization;

mounting the attachment member to the board member, wherein the cylindrical plug engages the keyhole and the lock-in plug engages the pin-lock hole.

9. The method of claim 8, wherein the cylindrical plug has a pass-through hole extending along a center of the cylindrical plug, wherein the pass-through hole is configured to receive a fastener.

10. The method of claim 9, wherein the method further comprising:

upon mounting, inserting the fastener into the cylindrical plug for securing the attachment member to the board member.

11. The method of claim 9, wherein the method further comprising:

upon mounting, inserting the fastener into the cylindrical plug for securing the attachment member and the board member to a wall.

12. The method of claim 9, wherein the method further comprising:

upon mounting, removing the attachment member from the board member;

inserting the fastener into the cylindrical plug for securing the attachment member to a wall.

13. The method of claim 12, wherein the attachment member further comprising:

a spacer plate configured to be removably positioned around the cylindrical plug and the lock-in plug, wherein the spacer plate is configured to protect and stabilize the cylindrical plug and the lock-in plug.

14. The method of claim 8, wherein the cylindrical plug is configured to expand under compression, forming a rivet type fastener.

15. The method of claim 8, wherein the storage system comprises a plurality of board members configured to be interlocked with each other through snap clips.

* * * * *